US007878306B2

(12) United States Patent
Siewert et al.

(10) Patent No.: US 7,878,306 B2
(45) Date of Patent: Feb. 1, 2011

(54) ELEVATOR SYSTEM WITHOUT A MOVING COUNTERWEIGHT

(75) Inventors: Bryan Robert Siewert, Westbrook, CT (US); Mark S. Thompson, Tolland, CT (US); Richard L. Hollowell, Hebron, CT (US)

(73) Assignee: Otis Elevator Company, Farmington, CT (US)

( * ) Notice: Subject to any disclaimer, the term of this patent is extended or adjusted under 35 U.S.C. 154(b) by 565 days.

(21) Appl. No.: 11/753,817

(22) Filed: May 25, 2007

(65) Prior Publication Data

US 2007/0227825 A1 Oct. 4, 2007

Related U.S. Application Data

(62) Division of application No. 10/550,655, filed as application No. PCT/US03/12266 on Apr. 22, 2003, now abandoned.

(51) Int. Cl.
*B66B 7/10* (2006.01)
*B66B 11/08* (2006.01)
*B66B 9/02* (2006.01)

(52) U.S. Cl. ..... 187/264; 187/250; 187/266

(58) Field of Classification Search ..... 187/411, 187/264, 266, 250, 404, 405; *B66B 11/08, B66B 7/08, 7/10*
See application file for complete search history.

(56) References Cited

U.S. PATENT DOCUMENTS

| | | | | |
|---|---|---|---|---|
| 12,640 A | | 4/1855 | Murtaugh | |
| 538,677 A | | 5/1895 | Hill | |
| 718,762 A | * | 1/1903 | Hiss | 187/264 |
| 789,765 A | * | 5/1905 | Smith | 187/266 |
| 1,132,769 A | * | 3/1915 | Gale, Sr. | 187/264 |
| 1,625,084 A | | 4/1927 | Hymans | |
| 2,563,894 A | * | 8/1951 | White | 49/226 |
| 3,101,130 A | | 8/1963 | Bianca | |
| 4,664,229 A | | 5/1987 | Obst | |
| 5,509,503 A | | 4/1996 | Salmon | |
| 5,526,901 A | | 6/1996 | Salmon | |
| 5,788,018 A | | 8/1998 | Mendelsohn et al. | |

(Continued)

FOREIGN PATENT DOCUMENTS

DE 19507628 A1 * 9/1996

(Continued)

*Primary Examiner*—Michael R Mansen
*Assistant Examiner*—Stefan Kruer
(74) *Attorney, Agent, or Firm*—Carlson, Gaskey & Olds PC

(57) ABSTRACT

An elevator system includes a cab supported for movement within a hoistway. A tension device, which remains close to one end of the hoistway, maintains a desired tension on a load bearing member that supports the cab and moves to achieve a desired placement of the cab. The load bearing member extends from a first end of the hoistway toward the cab, wraps around a first sheave supported on the cab, extends toward the first end of the hoistway, wraps around a second sheave supported near the first end of the hoistway, extends toward a second end of the hoistway, wraps about a third sheave supported near the second end of the hoistway, extends toward the cab, wraps around a fourth sheave supported on the cab, and extends toward the second end of the hoistway where it is secured to the tension device.

13 Claims, 3 Drawing Sheets

U.S. PATENT DOCUMENTS

| | | | |
|---|---|---|---|
| 5,878,847 | A | 3/1999 | Mustalahti et al. |
| 5,906,251 | A | 5/1999 | Aulanko et al. |
| 6,247,557 | B1 | 6/2001 | Kobayashi et al. |
| 6,364,063 | B1 | 4/2002 | Aulanko et al. |
| 6,471,012 | B2 | 10/2002 | Faletto |
| 2002/0125079 | A1 | 9/2002 | Mattlar et al. |

FOREIGN PATENT DOCUMENTS

| | | | | |
|---|---|---|---|---|
| EP | 1367017 | A1 | | 12/2003 |
| JP | 50127344 | A | | 10/1975 |
| JP | 03036182 | A | * | 2/1991 |
| JP | 03264482 | | | 11/1991 |
| JP | 11209032 | | | 3/1999 |
| JP | 200038274 | | | 2/2000 |
| JP | 2001524060 | T | | 11/2001 |
| WO | 0050328 | A3 | | 8/2000 |
| WO | 0164572 | A1 | | 9/2001 |
| WO | 02072461 | A1 | | 9/2002 |
| WO | 2004094289 | A1 | | 11/2004 |

* cited by examiner

ELEVATOR SYSTEM WITHOUT A MOVING COUNTERWEIGHT

CROSS REFERENCE TO RELATED APPLICATIONS

This application is a divisional of U.S. application Ser. No. 10/550,655 filed Sep. 27, 2005, now abandoned which is the U.S. National Phase of PCT/US03/12266 filed on Apr. 22, 2003.

FIELD OF THE INVENTION

This invention generally relates to elevator systems. More particularly, this invention relates to an elevator system having a roping arrangement that eliminates the need for a moving counterweight.

DESCRIPTION OF THE PRIOR ART

Elevator systems typically include a cab that is supported for movement between different levels in a hoistway. The cab is typically moved with a rope or other load bearing member that travels along sheaves that are positioned at appropriate locations within the system. A counterweight typically is associated with the cab and also supported by the load bearing member or rope. Typical counterweights move up and down through a portion of the hoistway at the same time that the cab moves.

While conventional arrangements are acceptable, those skilled in the art are always striving to make improvements. One area of consideration is maximizing the efficiency of and improving the economies of an elevator system. One area where this can be accomplished is by minimizing the amount of hoistway space required by the elevator system. Conventional counterweights require additional space within the hoistway because their travel must be accommodated. Additional costs are involved with the counterweight itself and providing additional guide rails for guiding the counterweight through the hoistway. There are other drawbacks associated with the installation, labor and time involved to appropriately assemble all of the components needed for conventional systems.

It is desirable to provide a more economical and efficient elevator system. This invention addresses that need by providing a unique arrangement of components within an elevator system.

SUMMARY OF THE INVENTION

In general terms, this invention is an elevator system having a load bearing assembly arranged in a manner that eliminates any need for a moving counterweight. The inventive system maximizes hoistway efficiency.

A system designed according to this invention includes a cab that is supported for movement within a hoistway. A load bearing member has one end secured near a first end of the hoistway. The load bearing member extends from the first end toward the cab where it wraps at least partially around a first sheave associated with the cab. The load bearing member extends back toward the first end of the hoistway where it wraps at least partially around a second sheave near the first end. The load bearing member extends toward a second, opposite end of the hoistway where it wraps at least partially around a third sheave near the second end. The load bearing member then extends toward the cab where it wraps at least partially around a fourth sheave associated with the cab and then extends toward the second end of the hoistway. Another end of the load bearing member is secured to a tension device that remains near the second end of the hoistway.

A motor causes movement of the load bearing member and corresponding movement of the cab. In one example, the motor is associated with one of the first through fourth sheaves such that one of them operates as a traction sheave for the system. In another example, a separate traction sheave is provided along with the motor. In systems designed according to the latter example, an advantageous placement of the motor outside of the hoistway is readily achievable.

In one example, the elevator system includes a 2:1 arrangement of the load bearing member. The inventive system facilitates using 2:1, 3:1, 4:1 or higher roping ratios to achieve desired system characteristics.

In one example, the tension device comprises a mass that remains close to the bottom of the hoistway. The weight of the mass ensures that a proper amount of tension exists on the load bearing member to achieve the desired cab movement and to counterbalance the weight of the cab as needed.

In one example system, the weight comprises a plurality of interlocking portions that are more readily transported to a location where the elevator system will be installed. Assembled on-site, the interlocking portions together make up the total weight that provides the desired amount of tension and counterbalancing in the elevator system.

In another example, a shell or form can be filled with a selected material to achieve the desired weight. In one example concrete is used.

In another example, the tension device comprises at least one spring element. In one example, the tension device comprises a pressurized device such as a hydraulic or pneumatic actuator that is adjustable to provide a desired amount of tension on the load bearing member.

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENTS

Figure 1:
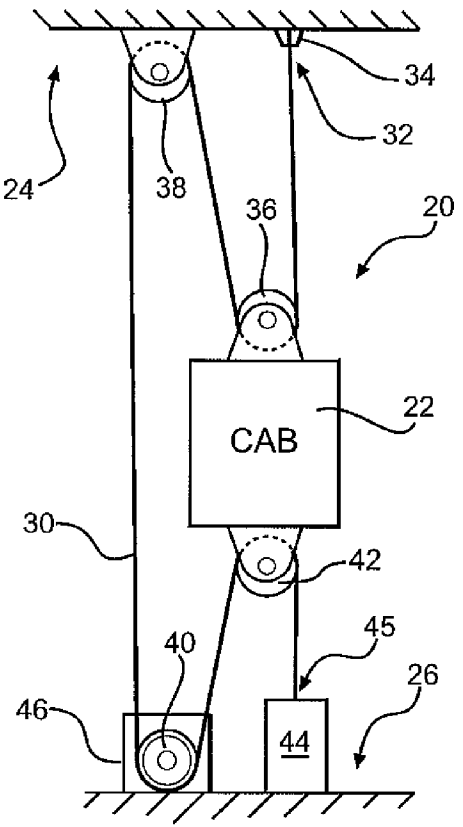
FIG. 1 schematically illustrates an example elevator system designed according to this invention.

FIG. 1 schematically illustrates an elevator system 20 that facilitates movement of a cab 22 to selected positions between a first end (i.e., top) 24 and a second end (i.e., bottom) 26 of a hoistway. The system 20 includes a load bearing member 30 that supports the weight of the cab and facilitates the desired movement of the cab 22. Those skilled in the art will appreciate that a variety of load bearing members 30 may be used in a system designed according to this invention. In one particular example system, coated steel belts are used. Another example system includes at least one steel rope. For purposes of discussion, the following description uses the term "belt" as interchangeable with any type of load bearing member and the term "belt" should not be construed in its strictest sense.

The load bearing member 30 has one end 32 secured near the first end 24 of the hoistway. The illustration schematically shows a conventional termination 34. The belt 30 extends from the one end toward the cab 22 where the belt wraps at least partially around at least one sheave 36 that is supported to move with the cab 22. The belt 30 then extends back toward the first end 24 of the hoistway where the belt wraps at least partially around another sheave 38.

The belt 30 then extends toward the second end 26 of the hoistway where the belt at least partially wraps around at least one sheave 40. From there, the belt 30 extends toward the cab 22 where it wraps at least partially around another sheave 42 supported to move with the cab through the hoistway. The belt 30 then extends again toward the second end 26 of the hoistway.

A tension device 44 secures the other end 45 of the belt 30 and ensures that an appropriate amount of tension is applied to the load bearing member to adequately support the cab and to provide the necessary amount of traction to achieve desired cab movement. Cab movement is achieved by controlling a machine 46, which includes a motor, in a known manner to cause movement of the belt about a drive sheave. In the example of FIG. 1, the machine 46 is associated with the sheave 40 near the second end 26 of the hoistway such that the sheave 40 is a traction or drive sheave. As the motor causes the belt 30 to move about the sheaves, the cab rises or descends, depending on the direction of motor and drive sheave movement.

The traction sheave is able to cause movement of the belt and the cab because the tension device 44 maintains the needed amount of tension on the belt 30. The tension device is supported to remain essentially stationary near one end of the hoistway. In the example of FIG. 1, the tension device is supported near the second end 26 of the hoistway. In another example, the tension device 44 is supported near the first end 24. Having a tension device that does not travel through the hoistway (such as a conventional counterweight) maximizes hoistway efficiency because it greatly reduces the amount of space needed to accommodate the elevator system components. The cost savings associated with eliminating a moving counterweight are a significant advantage of this invention.

FIG. 1 schematically illustrates only one example system arranged according to this invention. In this example, a 2:1 roping ratio is achieved where the belt 30 moves about the drive sheave twice as much as the vertical distance traveled by the cab 22 responsive to such movement of the belt. Other 2:1 arrangements are shown in FIGS. 2 through 5, for example. Other ratios such as 3:1 and 4:1 are possible with this invention.

Figure 2:
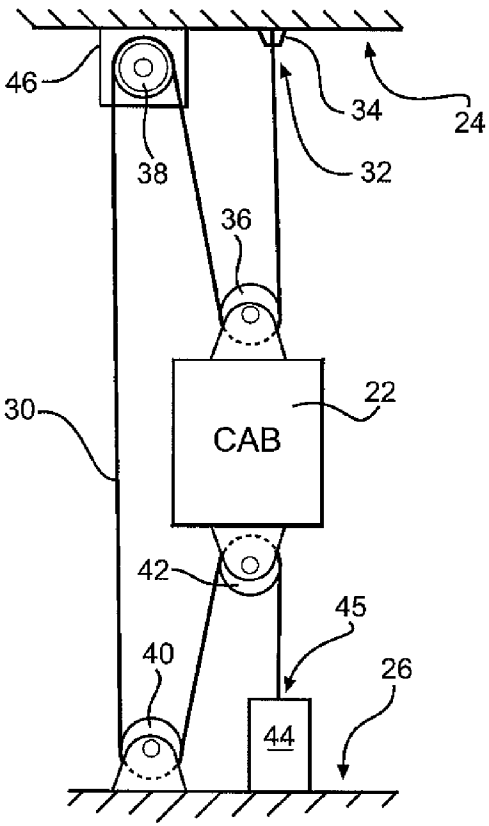
FIG. 2 schematically illustrates another example elevator system designed according to this invention.

The example arrangement of FIG. 2 differs from that of FIG. 1 primarily in the placement of the machine 46. In this example, the machine 46 is supported near the first end 24 of the hoistway. The sheave 38 is the traction sheave in this example.

Figure 3:
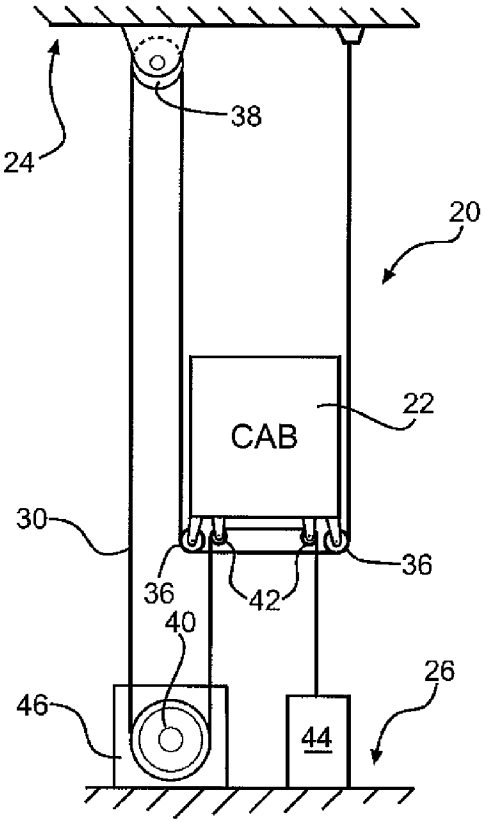
FIG. 3 schematically illustrates another example elevator system designed according to this invention.

FIG. 3 illustrates another example system designed according to this invention. In this example, the sheaves associated with the cab 22 are in a so-called underslung arrangement. The sheaves 36 are supported under the cab 22 even though the portions of the belt 30 that extend toward the first end 24 of the hoistway wrap about the sheaves 38. Depending on the particular cab supporting structure, such an arrangement may provide further system economies.

Figure 4:
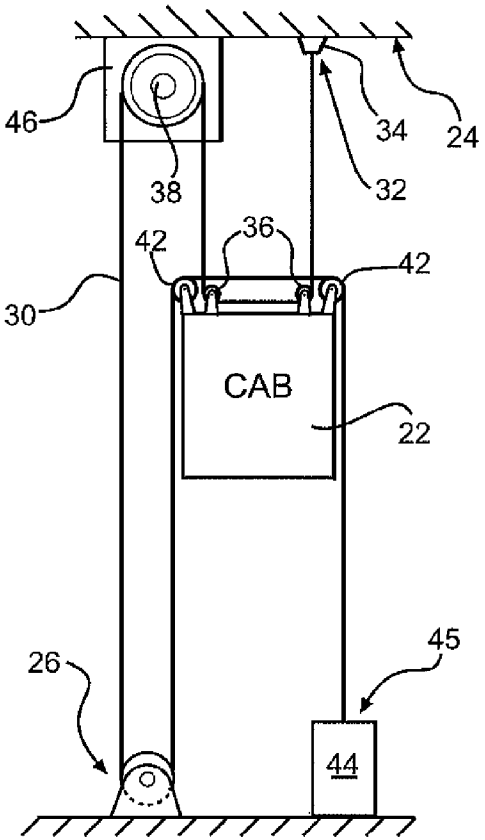
FIG. 4 schematically illustrates another example elevator system designed according to this invention.

FIG. 4 shows another alternative arrangement with a so-called overslung arrangement. In this example, the sheaves 42 and the sheaves 36 are supported above the cab 22.

Figure 5:
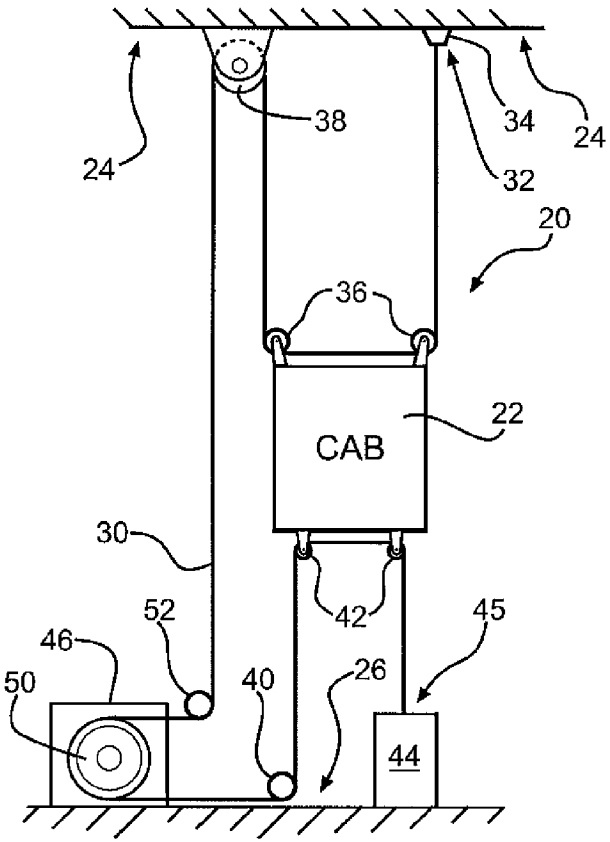
FIG. 5 schematically illustrates another example elevator system designed according to this invention.

FIG. 5 schematically illustrates another example system configuration. Here, the machine 46 is not directly associated with one of the sheaves as used in the previous examples. This example includes a dedicated drive sheave 50 associated with the machine 46. A deflector sheave 52 facilitates directing the belt 30 to the machine location and back to the path to be followed to cooperate with the sheaves in the hoistway. In one example designed according to this embodiment, the machine 46 is located outside of the hoistway envelope. Such a configuration allows strategically placing the machine at any desirable location.

Figure 6:
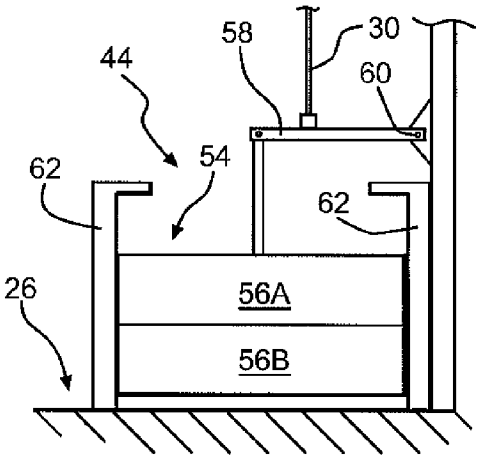
FIG. 6 schematically illustrates one example tension device for use in a system designed according to this invention.

The tension device 44 may take various forms. In one example, the tension device comprises a mass that remains relatively stationary. In the example of FIG. 6, a mass 54 is located near the second end 26 of the hoistway. The example mass 54 has interlocking portions 56*a* and 56*b* that allow assembling the mass at the installation site. By making the mass 54 of multiple portions that can be secured together at the job site, transporting the mass 54 to the job site and installing the elevator system can be simplified. A variety of interlocking or connecting arrangements can be used to secure the portions 56*a*, 56*b* together as needed.

In another example, the mass 54 comprises a shell or a form that is selectively filled at the installation location. A desired amount of a selected material such as concrete fills the shell or form to achieve the desired weight.

The total weight of the mass 54 preferably is set so that a desired amount of tension is maintained on the load bearing member 30 to achieve the desired elevator system operation. In one example, the mass 54 preferably is greater than or equal to one-half of the sum of the mass of the cab 22 and the duty load mass expected to be carried by the cab 22. This relationship can be expressed by the equation: $M_{CWT}=(M_{CAR}+M_{DL})/2$. This relationship assumes that acceleration of the cab can be neglected and assumes an example system where the traction ratio (i.e., the ratio of tension on either side of the drive sheave 34) is approximately 2.

In another example, the size of the mass 54 preferably is determined according to the following equation:

$$M_{CWT} = \frac{0.5\,(M_{CAR} + M_{DL})(g + a) + 3\,H\rho a + 0.25\,H\rho_{TC}(g + a)}{g(TR - 1)}$$

where:

ρ is the linear rope density (kg/m),

H is the building rise (m), a is the car acceleration ($m/s^2$), g is gravity ($m/s^2$), $M_{CAR}$ is the car mass (kg), $M_{DL}$ is the duty load mass (kg), $M_{CWT}$ is the counterweight mass (kg), $\rho_{TC}$ is the linear travel cable density (kg/m), and TR is the traction ratio.

As known, the amount of traction is a function of the angle of wrap of the belt or rope and the coefficient of friction. Choosing components that provide greater friction (i.e., a flat belt instead of a round rope) allows using a smaller mass 54. Preferably, the mass 54 is smaller that a conventional counterweight to enhance the savings achieved by the inventive approach.

The example of FIG. 6 includes a levered assembly 58 that supports the mass 54 about a pivot 60 that is appropriately secured to a hoistway wall, for example. The levered assembly 58 allows the belt 30 to be secured at a position relative to the suspended mass 54 to obtain a mechanical advantage. Such an arrangement further enhances the ability to use a smaller mass 54 and yet achieve the same tension provided by a much larger counterweight.

Some movement of the mass 54 is required under certain conditions during elevator system operation. Changes in the condition or load on the load bearing member 30, for example, may require slight movement of the mass 54 to accommodate such situations. Elastic changes in the load bearing member 30 are typical and some limited movement accommodates such changes. Any such movement of the mass 54, however, is very limited compared to the movement of the cab 22 within the hoistway. Accordingly, the mass 54 is effectively stationary and any movement is far less than the amount of movement a conventional counterweight experiences in a conventional elevator system.

A guide arrangement 62 is schematically shown in FIG. 6 for accommodating any required movement of the mass 54 relative to the bottom 26 of the hoistway. In this example, the guide arrangement 62 includes a pair of guide rail-like structures that are secured in place in the hoistway. One of the rails 62 has a base secured to a floor at the bottom 26 of the hoistway. The other rail 62 is secured to a hoistway wall in a conventional manner.

Figure 7:
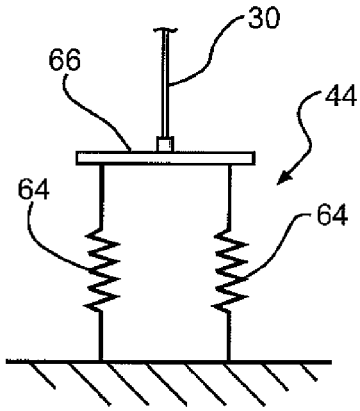
FIG. 7 schematically illustrates another example tension device for use in a system designed according to this invention.

Another example tension device 44 is schematically shown in FIG. 7. This example includes at least one spring member 64 that tensions the belt 30. A connector 66 facilitates securing a termination at the end 45 of the belt 30 to the arrangement of spring members 64.

Figure 8:
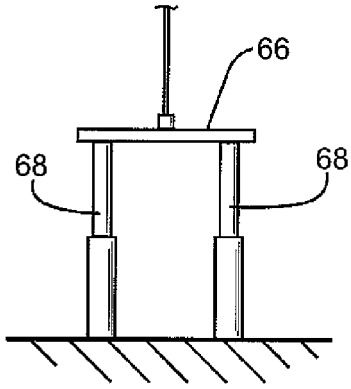
FIG. 8 schematically illustrates another example tension device for use in a system designed according to this invention.

Still another example tension device 44 is schematically shown in FIG. 8. In this example, at least one pressurized actuator 68 provides the tension needed to maintain the desired system operation. The actuators 68 in one example are hydraulic. In another example, the actuators are pneumatic. Conventional tension adjustment techniques facilitate providing the desired amount of tension. The connector 66 facilitates securing the belt 30 in a manner that allows a plurality of actuators 68 to provide the needed tension.

Those skilled in the art who have the benefit of this description will be able to determine how to select an appropriate mass, spring assembly or pressurized actuator arrangement, for example, to meet the needs of their particular situation.

A variety of advantages are available when designing an elevator system according to this invention. One significant advantage is that the use of hoistway space is maximized in a way that conserves space and, therefore, increases the economies of the elevator system. Because the tension device 44 remains basically stationary in a selected location within the hoistway, no separate counterweight guide rails are required, the number of other components can be reduced and the total size of the hoistway may be reduced if desirable.

Another advantage is that drive and brake components can be simplified. For example, because there is no moving counterweight, bracing in only one direction is needed.

Figure 9:
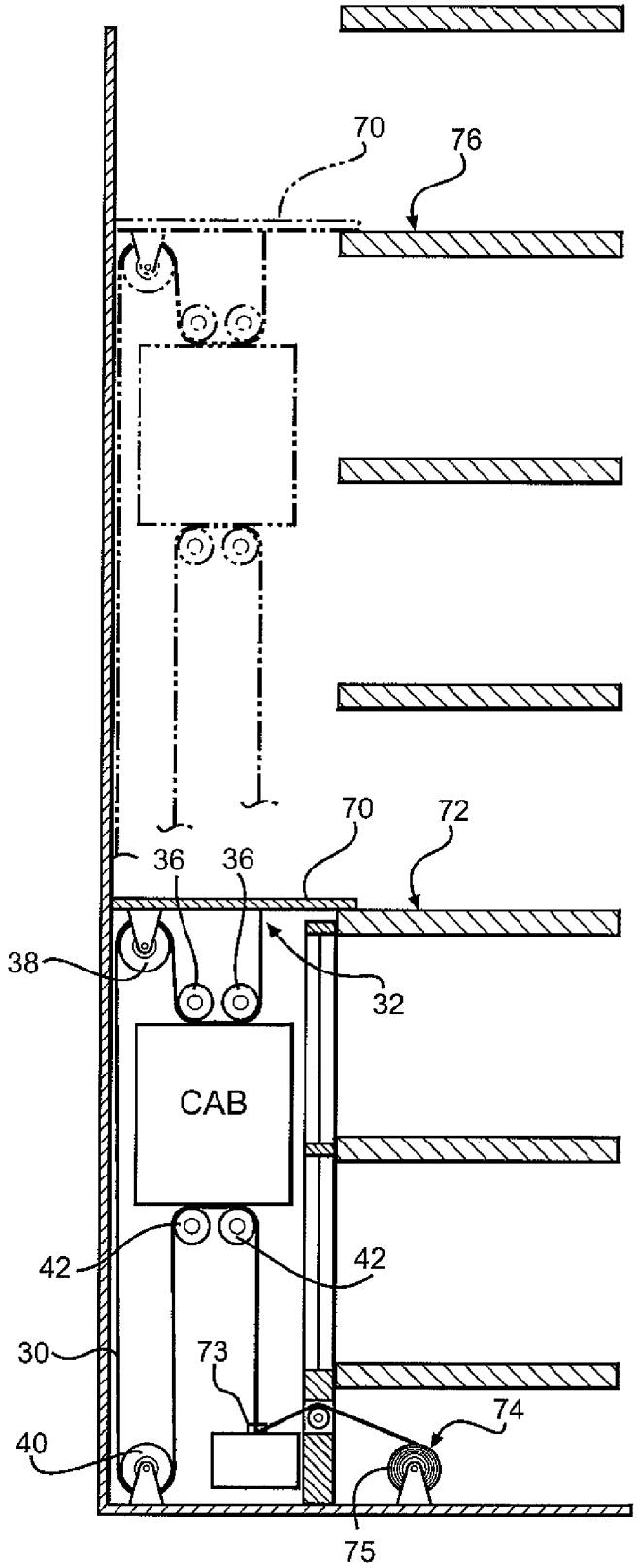
FIG. 9 schematically illustrates a method of installing an elevator system designed according to this invention.

Another advantage to a system designed according to this invention is that it makes a jump-lift installation approach readily workable. FIG. 9 schematically illustrates another example system designed according to this invention temporarily installed in a first condition within a hoistway. In this example, a top support 70 is secured in place relative to the hoistway at a first level or height 72 within a building. This may be done when the building is still under construction, for example. Securing the appropriate components of the elevator system to the top support 70 can be accomplished in a conventional manner. The top support 70 may be secured in the desired position in the hoistway in a conventional manner.

Under this condition, the cab 22 may be used to transport items between different levels within the building below the height 72. In this temporarily installed condition, a portion 74 of the load bearing member 30 is maintained on a spool 75 separate from the working portion of the elevator system. A selected location on the load bearing member 30 may be secured to the tension device 44 using a conventional clamping mechanism 73. By leaving a section of slack or excess belt 74 effectively outside of the system, the load bearing member 30 has a first length within the system in the temporarily installed condition.

A second-installed position is shown in phantom in FIG. 9. In this condition, the top support 70 is supported at a second level or height 76 within the building. The inventive arrangement allows such a transition from the first height 72 to the second height 76 by sufficiently securing the cab in a safe position, releasing the load bearing member from the connection to the tension device 44, moving the top support 70 to the second height position and then resecuring the load bearing member 30 to the tension device 44. In the second position, the previously excess portion 74 is at least partially within the operative system and the load bearing member 30 has a second length within the elevator system, which is greater than the first length. In this position, the elevator cab 22 is available at more levels within the building.

This process may be repeated as often as necessary, depending on the needs of a particular situation and the height of a particular building. The inventive arrangement allows for installing the elevator system in a jump lift sequence in a more efficient manner. Additionally, the ability to handle the excess length of load bearing member between installed positions is simplified with a system designed according to this invention.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator system, comprising:

a cab that is supported for movement within a hoistway;

at least one load bearing member having a first portion secured near a first end of the hoistway, the load bearing member being arranged within the system such that the load bearing member extends from the first end of the hoistway toward the cab, wraps at least partially around a first sheave supported for movement with the cab, extends from the first sheave toward the first end of the hoistway, wraps at least partially around a second sheave supported near the first end of the hoistway, extends from the second sheave toward a second end of the hoistway, wraps at least partially about a third sheave supported near the second end of the hoistway, extends toward the cab from the third sheave, wraps at least partially around a fourth sheave supported for movement with the cab, and extends from the fourth sheave toward the second end of the hoistway;

a tension device near the second end of the hoistway that is configured to secure a second portion of the load bearing member near the second end of the hoistway and to maintain tension on the load bearing member throughout all movement of the cab within the hoistway, the tension device comprising a mass that is configured to remain near the second end of the hoistway; and at least one guide member positioned to guide limited movement of the mass.

2. The system of claim 1, comprising:

a machine that is configured to cause movement of the load bearing member about the sheaves to achieve a desired movement of the cab.

3. The system of claim 2, wherein the machine is supported near the first end of the hoistway.

4. The system of claim 2, wherein the machine is associated with at least one of the first, second, third or fourth sheaves such that the sheave associated with the machine is a traction sheave in the system.

5. The system of claim 2, comprising:

a traction sheave associated with the machine and at least one deflector sheave, wherein the traction sheave and the deflector sheave contact the load bearing member between two of the first, second, third and fourth sheaves.

6. The system of claim 1, wherein the cab has a cab weight and is configured to carry a duty load weight, and wherein the mass has a weight that is at least equal to one-half of the sum of the cab weight and the duty load weight.

7. The system of claim 1, wherein the mass comprises a plurality of portions secured together.

8. The system of claim 1, wherein the mass comprises a shell at least partially filled with a selected material.

9. The system of claim 1, wherein the tension device comprises a lever member having a first end that is supported to pivot relative to a portion of the hoistway and second end secured to the mass of the tension device, and wherein the load bearing member is secured to the lever member at a selected location between the first and second lever ends.

10. The system according to claim 1, wherein the load bearing member is roped in a roping ratio of greater than 2:1.

11. The system according to claim 1, wherein more than one of the plurality of cab-supported sheaves redirect the load bearing member toward the first end of the hoistway.

12. The system according to claim 1, wherein there is a plurality of the second hoistway sheaves, each of which redirects the load bearing member toward the first end of the hoistway.

13. The system according to claim 1, wherein an end of the tension member is secured to the tension device.

* * * * *